US005308530A

United States Patent [19]

Aronson et al.

[11] Patent Number: 5,308,530

[45] Date of Patent: May 3, 1994

[54] DETERGENT COMPOSITIONS CONTAINING POLYCARBOXYLATES AND CALCIUM-SENSITIVE ENZYMES

[75] Inventors: Michael P. Aronson, Nyack, N.Y.; Ingrid Brase, Cranbury, N.J.; David L. Elliott, Hawthorne, N.J.; John F. Hessel, Metuchen, N.J.; Carmine P. Iovine, Bridgewater, N.J.; John C. Leighton, Flanders, N.J.; J. Thomas McCown, Cresskill, N.J.

[73] Assignee: Lever Brothers Company, Division of Conopco, Inc., New York, N.Y.

[21] Appl. No.: 616,504

[22] Filed: Nov. 21, 1990

[51] Int. Cl.[5] ..... C11D 3/37; C11D 3/386

[52] U.S. Cl. ..... 252/174.12; 252/174.23; 252/174.24; 252/DIG. 2; 252/DIG. 11; 252/DIG. 14; 252/DIG. 15; 252/DIG. 12

[58] Field of Search ..... 252/174.23, 174.24, 252/174.12, DIG. 12, DIG. 2, DIG. 11, DIG. 14, DIG. 15

[56] References Cited

U.S. PATENT DOCUMENTS 3,719,647 3/1973 Hardy et al. ..... 260/86.1 R
3,915,921 10/1975 Schlatzer, Jr. ..... 260/17.4

(List continued on next page.)

FOREIGN PATENT DOCUMENTS 8944505 11/1981 Australia ..... 252/174.24
0301882 2/1989 European Pat. Off. .

(List continued on next page.)

OTHER PUBLICATIONS

*Novo's Handbook of Practical Biotechnology* C. O. L. Boyce, Ed., 1986, pp. 54–57 (no month available).

The Effect of Builders on the Activity of Protease Enzymes, M. Sato, et al., JAOCS, vol. 67, No. 11, Nov. 1990, pp. 711–716.

*Primary Examiner*—Linda Skaling
*Assistant Examiner*—Kery A. Fries
*Attorney, Agent, or Firm*—Mary E. Porter

[57] ABSTRACT

This invention provides detergent compositions, particularly liquid compositions, utilizing one or more polycarboxylates as builders, or as anti-redeposition agents, wherein the polycarboxylates are novel polymers comprising repeating units of the structure:

$$\left[A-B\right]_m\left[C\right]_n$$

wherein m is a mole fraction from 0.70 to 0.95; n is a mole fraction from 0.05 to 0.30; A is derived from at least one ethylenically unsaturated carboxylic acid monomer; B is derived from at least one ethylenically unsaturated carboxylic acid monomer and B is not A; and C is:

wherein X is —H, or a combination thereof, $R^1$ is —H, $—CH_3$, or $—(CH_2)_qCH_3$, or a combination thereof, and q is 1–5; $R^2$ is:

or $R^3$ , or a combination thereof, and $R^3$ is a $C_8$–$C_{18}$ linear or branched alkyl chain; the interpolymer being prepared by polymerizing the monomers in a solvent system in which the monomers and interpolymer are soluble. Also provided are liquid detergent formulations containing calcium-sensitive enzyme(s) wherein selected builders are employed which improve detergency without destabilizing the enzyme.

35 Claims, 5 Drawing Sheets

U.S. PATENT DOCUMENTS

| | | | |
|---|---|---|---|
| 3,940,351 | 2/1976 | Schlatzer, Jr. | 260/17.4 |
| 4,318,818 | 3/1982 | Letton et al. | 252/174.12 |
| 4,390,670 | 6/1983 | Walinsky | 526/79 |
| 4,559,159 | 12/1985 | Denzinger et al. | 252/174.24 |
| 4,603,005 | 7/1985 | Chaussee | 252/174.24 |
| 4,612,352 | 9/1986 | Schafer et al. | 525/404 |
| 4,663,071 | 5/1987 | Bush et al. | 252/174.19 |
| 4,686,254 | 8/1987 | Lochhead et al. | 524/99 |
| 4,797,223 | 1/1989 | Amick et al. | 252/174.23 |
| 4,874,537 | 10/1989 | Peterson et al. | 252/99 |
| 4,891,149 | 1/1990 | Nagarajan et al. | 252/110 |
| 4,908,150 | 3/1990 | Hessel et al. | 252/174.12 |
| 4,946,627 | 8/1990 | Leighton et al. | 252/542 |
| 4,959,179 | 9/1990 | Aronson et al. | 252/135 |
| 5,004,557 | 4/1991 | Nagarajan et al. | 252/174.24 |
| 5,066,749 | 11/1991 | Leighton et al. | 252/174.24 |

FOREIGN PATENT DOCUMENTS

| | | | |
|---|---|---|---|
| 0326792 | 8/1989 | European Pat. Off. . | |
| 0342177 | 11/1989 | European Pat. Off. . | |
| 0344828 | 12/1989 | European Pat. Off. | C11D 9/04 |
| 0346995 | 12/1989 | European Pat. Off. . | |
| 62164278 | 1/1989 | Japan | C11D 17/08 |
| 90/13622 | 11/1990 | PCT Int'l Appl. | C11D 3/37 |
| 668539 | 3/1952 | United Kingdom . | |
| 758203 | 10/1956 | United Kingdom . | |

DETERGENT COMPOSITIONS CONTAINING POLYCARBOXYLATES AND CALCIUM-SENSITIVE ENZYMES

BACKGROUND OF THE INVENTION

This invention relates to detergent compositions containing polycarboxylates as builders or anti-redeposition agents.

This invention also relates to detergent compositions containing stabilized calcium-sensitive enzymes, wherein the enzymes are not destabilized by the addition of selected builders, including hydrophobically-modified polycarboxylate builders, to the detergent compositions.

The hydrophobically-modified polycarboxylate utilized herein are interpolymers of two or more different ethylenically unsaturated carboxylic acid monomer(s) and one or more ethylenically unsaturated comonomer(s), having a $C_8$–$C_{18}$ linear or branched alkyl chain ("the polycarboxylates"). In liquid isotropic detergent compositions these builders do not separate into different phases, thus do not require the addition of a compatibilizing agent to the detergent. The polycarboxylates also may be used as anti-redeposition agents in detergents.

The polycarboxylates are prepared by solution polymerization of hydrophobically-modified monomers and carboxylic acid-containing monomers at hydrophobic monomer levels as low as 5 mole percent of the total monomers. The polycarboxylates obtained thereby have a more homogeneous distribution of all monomer units in the polymer chain than those prepared by other processes from identical starting monomers. Better liquid detergent stability, as well as enzyme stability, may be achieved by the use of these homogeneous polycarboxylates.

It is well known that the selection of one copolymerization process over another may affect copolymer qualities as much as, if not more than, other variables, such as monomer selection, monomer ratios and the like. For example, substantially homogeneous acrylate-maleate copolymers have been prepared by controlling the rate of addition of an acrylic monomer to a solution of maleic anhydride in a chain-transfer solvent so as to maintain the monomers and newly formed copolymer in solution. U.S. Pat. No. 4,390,670, issued Jun. 28, 1983, to Walinsky.

Furthermore, copolymers prepared by a single charge, batch process in benzene are not suited for use herein, even though these polymers are derived from comonomers which include an unsaturated carboxylic acid and acrylic esters having aliphatic chain length of 10 to 30 carbon atoms. See, U.S. Pat. No. 3,915,921, issued Oct. 28, 1975 to Schlatzer, Jr. The Schlatzer copolymers are reported to be useful as thickeners for electrolyte-containing materials, including ionic detergents. The Schlatzer copolymers may comprise from 5 to 50 weight percent acrylic ester monomer. The copolymers are insoluble in benzene with the result that the copolymer as recovered by centrifuging the reaction mixture. The copolymer is preferably prepared with an additional, crosslinking monomer so as to provide maximum viscosity.

U.S. Pat. No. 3,940,351, issued Feb. 24, 1976 to Schlatzer, Jr., teaches the preparation of copolymers of an unsaturated copolymerizable carboxylic acid monomer and 10 to 30 carbon atom alkyl acrylate esters in a halogenated solvent (preferably one which is a solvent for the monomers but not for the polymer) by a single charge batch process wherein the polymer is recovered by centrifuging the reaction mixture. Maximum polymer viscosity in electrolyte-containing aqueous media is an object of the patent, and optional crosslinking monomers are preferably employed to achieve this object. Although Schlatzer discloses the use of these polymers as thickeners in ionic detergents, the Schlatzer polymers are not suited for use herein, being compositionally and functionally distinct from the polymers prepared by the process disclosed herein. The Schlatzer polymers are designed to thicken, whereas the polymers herein advantageously contribute little to the viscosity of isotropic liquid detergents.

Detergent compositions are generally a blend of a surfactant(s), builder(s) and, optionally, ion exchanger(s), filler(s), alkali(es), anticorrosion material(s), anti-redeposition material(s), bleach(es), enzyme(s), buffer(s), optical brightener(s), fragrance(s), solvent(s) and other components selected for particular applications.

Builders are used to improve the effectiveness of detergent compositions and thereby improve their cleaning powers. The manner in which detergent builders improve the cleaning powers of detergent compositions is related to a combination of factors such as emulsification of soil particles, solubilization of water insoluble materials, promoting soil suspension in the wash water so as to retard soil redeposition, sequestering of metallic ions, and the like. Builders enhance (or "build") the cleaning efficiency of surfactants by forming complexes with hard water ions, aiding in keeping soil from redepositing on fabric being washed and buffering or moderating the pH of wash water.

Many materials are or have been used as builders in detergent formulations. None of the high capacity calcium-binding builders have been recommended for use in the presence of calcium-sensitive enzymes in liquid detergent formulations. As heavy duty liquid laundry detergents gain market share, there is a particular need for effective builders which are compatible with liquid detergents and do not detract from enzyme stability.

At a minimum, detergent builders for liquid isotropic detergents must be effective calcium binders, compatible with the liquid formulations and shelf-stable. Builders which precipitate from the liquid, or cloud or gel the liquid, or cause phase separation or solid settlement initially or upon storage, are not suitable for use in liquid detergents unless an effective compatibilizing agent can be found. Structured liquids and powdered detergent formulations, which have less demanding requirements for builder compatibility and stability, can employ a greater variety of builders without an added compatibilizing agent.

Citric acid and its salts are used commercially as builders in liquid detergent formulations. While very compatible in liquids and free of known adverse effects on enzyme stability, the citrates do not bind calcium nearly as effectively as the builders used in powdered detergents.

Also used commercially are the liquid detergent builders comprising ether carboxylate salts (i.e., tartrate monosuccinate and disuccinate salts) which are disclosed in U.S. Pat. No. 4,663,071, issued May 5, 1987 to Bush, et al. Among the polymeric materials that have been suggested for use as liquid detergent builders are polymeric polycarboxylic acids. U.S. Pat. No.

4,797,223, which issued Jan. 10, 1989 to Amick, et al., discloses water soluble polymers with surfactant radicals distributed along a carboxylated polymer chain. The polymer may contain surfactant end groups. The surfactant radical is selected from a group of radicals having poly(alkyleneoxy) blocks characterized by a hydrophobic portion and a hydrophilic portion.

U.S. Pat. No. 4,612,352 which issued Sep. 16, 1986 to Schafer, et al., discloses water soluble or water dispersible graft polymers having at least 10 percent, by weight, of a hydrophilic graft constituent bonded to carbon and at least one hydrophobic radical bonded to the graft constituent by a polyglycol ether chain. These graft polymers contain pendant surfactant-type groups.

U.S. Pat. No. 4,559,159, which issued Dec. 17, 1985 to Denzinger, et al., discloses polymers of ethylenically unsaturated mono- and di-carboxylic acids, together with not more than 15 percent, by weight, of carboxyl-free monomers, having a terminal hydroxy radical and one or more alkylene oxide radicals.

Unlike the polycarboxylates disclosed herein, which comprise the polymerized residue of hydrophobic alkyl ester monomers and hydrophilic carboxylic acid monomers, and are polymers having overall surfactant character, each of these builder compositions acquire liquid detergent formulation compatibility through the presence of pendant surfactant-type radicals on the carboxylated polymer chain. It is unexpected that liquid detergent compatibility may be achieved without employing surfactant radicals in the polymer.

It is even more unexpected that these builders do not destabilize calcium-sensitive enzymes in liquid detergent formulations, yet provide builder efficacy equivalent to that of builders used commercially in powdered detergents.

The desirability of using enzymes in cleaning compositions is well known. Protease enzymes, for example, are useful for their ability to reduce proteinaceous stain which then can be readily washed away. Proteases are calcium-sensitive enzymes which denature when calcium is removed from calcium binding sites on the enzyme. See, *Novo's Handbook of Practical Biotechnology*, C. O. L. Boyce, Ed., Novo Industri A/S, 1986, pp. 54–57; and U.S. Pat. No. 4,318,818, issued Mar. 9, 1982, to Letton, et al.

The stability of enzymes, e.g., lipases and proteases, in commercial liquid detergent compositions is generally poor due to various reasons. Builders which strongly bind calcium may strip the calcium from calcium-sensitive enzymes, causing loss of enzyme activity, initially, during storage of detergent compositions, or during use. The surfactant found in such detergent compositions may induce denaturation of the enzyme. When a protease is present in the composition, the protease can cause proteolytic digestion of other enzymes, or of itself in a process called autolysis.

Proteins, such as those taught in U.S. Pat. No. 4,842,758 to Crutzen and U.S. Pat. No. 4,842,767 to Warschewski, et al., are known to improve enzyme stability in heavy duty liquid detergents (HDLs).

Other approaches used for stabilization of enzymes in HDLs include the use of aminated polysaccharides such as taught in U.S. Pat. No. 4,011,169; the use of calcium and carboxylic acids (preferably formate) such as disclosed in U.S. Pat. Nos. 4,305,837, 4,490,285 and 4,537,707; the use of calcium with alkyl diacids (succinic, adipic) such as disclosed in U.S. Pat. No. 4,529,525; and the use of aliphatic glycols with and without boron containing compounds such as taught in U.S. Pat. Nos. 3,819,528, 4,462,922, 4,404,115 and 4,652,394.

West German published patent application No. P 29 37 012.5 teaches agents for stabilizing enzymes which are the protein reaction products of protein substrates and (1) ammonia or primary or secondary amines containing up to 20 carbon atoms and/or (2) aliphatic epoxides containing 2 to 18 carbon atoms. Proteins used as substrates for addition of these groups include gelatin, collagen, zein, casein, soy protein and other plant proteins as well as so-called single-cell proteins. Gelatin, collagen or casein are said to be preferred.

The use of selected builders to avoid destabilizing calcium-sensitive enzymes in detergent compositions has not been previously disclosed. It has been found that selection of a builder having a pKCa (i.e., the intrinsic calcium binding constant, as determined by the method of Example 5, herein) of at least 5.0 in a low ionic strength system (e.g., about 20 mmols/liter monovalent ion) and having a pKCa of less than 3.5 in a high ionic strength system (e.g., about 400 mmols/liter monovalent ion) will permit formulation of a detergent composition containing highly effective builders and enzymes, particularly proteases. Preferred builders include the polycarboxylates described herein. The pKCa is calculated as set forth in Example 5, herein.

SUMMARY OF THE INVENTION

This invention provides detergent compositions comprising from about 0.5% to 90% by weight of surfactant(s) and from about 1 to 80% by weight of builder(s), wherein at least one builder is an interpolymer comprising repeating units of the structure:

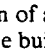

wherein m is a mole fraction from 0.70 to 0.95; n is a mole fraction from 0.05 to 0.30; A is derived from at least one ethylenically unsaturated mono or di-carboxylic acid monomer; B is derived from at least one ethylenically unsaturated mono or di-carboxylic acid monomer and B is not A; and C is:

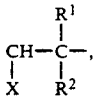

wherein X is —H,

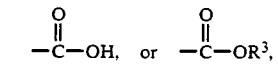

or a combination thereof, $R^1$ is —H, $—CH_3$, or $—(CH_2)_qCH_3$, or a combination thereof, and q is 1–5; $R^2$is:

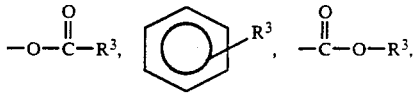

or $R^3$, or a combination thereof, and $R^3$ is a $C_8$–$C_{18}$ linear or branched alkyl chain; the interpolymer being prepared by polymerizing the monomers in a solvent system in which the monomers and interpolymer are soluble. A homogeneous interpolymer is provided by slowly adding the monomer from which C is derived to the carboxylic acid monomer(s) over a sufficient period of time to instantaneously and uniformly copolymerize the monomers.

The detergent composition may comprise additional builder(s) and surfactant(s), and may comprise 0.5 to 10% by weight buffer(s) and 1 to 15% by weight compatibilizing agent(s) when in liquid form. The polycarboxylates may be prepared from the copolymerization of monomers exemplified by maleic acid, acrylic acid and a $C_{12}$ or a $C_{18}$ linear alkyl chain-containing monomer, such as lauryl methacrylate. This invention also provides detergent compositions comprising from 0.5 to 65% by weight of surfactant(s), 1 to 80% by weight of builder(s), and up to 1% by weight of an anti-redeposition agent, wherein the anti-redeposition agent is a interpolymer comprising repeating units of the structure:

$$\left[A-B\right]_m\left[C\right]_n$$

wherein m is a mole fraction from 0.70 to 0.95; n is a mole fraction from 0.05 to 0.30; A is derived from at least one ethylenically unsaturated mono or di-carboxylic acid monomer; B is derived from at least one ethylenically unsaturated mono or di-carboxylic acid monomer and B is not A; and C is:

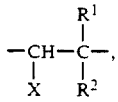

wherein X is —H,

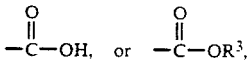

or a combination thereof, $R^1$ is —H, $—CH_3$, or $—(CH_2)_qCH_3$, or a combination thereof, and q is 1–5; $R^2$ is:

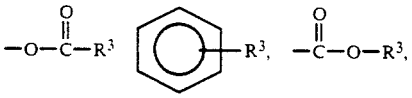

or $R^3$, or a combination thereof, and $R^3$ is a $C_{8-C18}$ linear or branched alkyl chain; the interpolymer being prepared by polymerizing the monomers in a solvent system in which the monomers and interpolymer are soluble. A homogeneous interpolymer is provided by slowly adding the monomer from which C is derived to the carboxylic acid monomer(s) over a sufficient period of time to instantaneously and uniformly copolymerize the monomers.

This invention also provides liquid detergent compositions, comprising a calcium-sensitive enzyme, wherein the calcium-sensitive enzyme is not destabilized by the addition to the detergent composition of a builder having an intrinsic calcium binding constant of less than 3.5 at an ionic strength of about 400 mmols/liter of monovalent ion, and an intrinsic calcium binding constant of at least 5.0 at an ionic strength of about 20 mmols/liter of monovalent ion. These detergent compositions preferably comprise the polycarboxylates disclosed herein as builders.

Detergent compositions of this invention comprise any of the compositions which are used for cleaning purposes, wherein the builder is selected from the builders disclosed herein. The detergent compositions may also contain one or more additional builders. Thus, the compositions include liquid and dry blends useful for household laundry detergents, automatic dishwashing machine detergents, hard surface cleaners, and industrial and specialty cleaning products.

DESCRIPTION OF THE DRAWINGS

FIGS. 2 and 3 illustrate the effect of monomer equal slow add time during the polymerization process on calcium binding capacity of the interpolymers for samples 62A, 77A, 77B, 53B, 49A, 57B and 49B, which are described in Table VI herein FIG. 4 illustrates the effects of percent initial monomer charge and monomer slow add time during the polymerization process on calcium binding capacity of the interpolymers.

DESCRIPTION OF THE PREFERRED EMBODIMENTS

DETERGENT COMPOSITIONS

Figure 1:
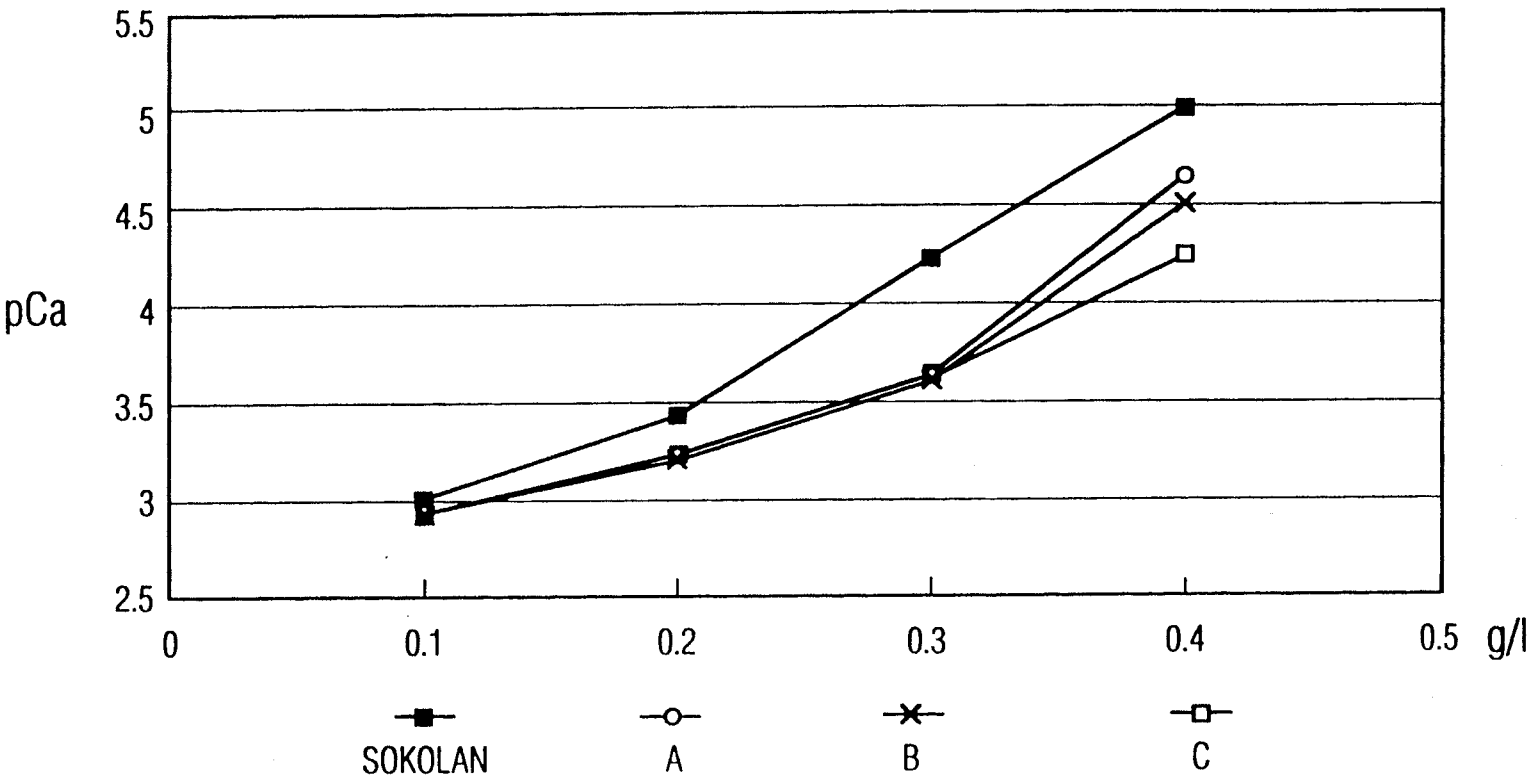
FIG. 1 illustrates calcium sequestration by polycarboxylates at an initial calcium ion load of 120 ppm. In this figure, the negative log of the free calcium ion concentration remaining after treatment is plotted against the quantity of polycarboxylate used in the treated samples. Test methods and data used to generate this graph are set forth in Example 2 and Table II, herein.

The detergent formulations comprise from about 0.5 to 90% by weight of a Surfactant, or a blend Of surfactants; and 0.1 to 80% by weight of one of the builder polymers disclosed herein, or a blend of builders containing at least one of the polycarboxylate builders. The enzyme-containing detergent composition also contain from about 0.05 to 50,000 GU/g of a calcium-sensitive enzyme, or a blend of enzymes containing at least one calcium-sensitive enzyme. In a preferred embodiment, from about 0.5 to 30% by weight of a surfactant, or a blend of surfactants, and from about 2 to 65% by weight of the polycarboxylate builder, or a blend of builders containing at least one polycarboxylate builder, and from 0.1 to 50 GU/g of an enzyme, or a blend of enzymes enzyme, are employed.

If a blend of builders is employed, the polymers disclosed herein may be present at lower percentages, provided that the total amount of builder is at least 1% of the detergent formulation. When used in conjunction with one or more co-builders, these polymers may function primarily as anti-redeposition or anti-incrustation agents (i.e., when the polymers are less than 1% of the formulation).

The calcium-sensitive enzymes are typically proteases. Proteases added to these detergents can be of vegetable, animal or microbial origin. Preferably, it is of the latter origin, which includes yeasts, fungi, molds and bacteria. Particularly preferred are bacterial subtilisin type proteases, obtained from e.g., particular strains of *B. subtilis* and *B. licheniformis*. Examples of suitable commercially available proteases are Alcalase, Savinase, Esperase, all of NOVO Industri A/S; Maxatase and Maxacal of Gist-Brocades; and Kazusase of Showa Denko. The amount of proteolytic enzyme included in the composition ranges from 0.05–50,000 GU/g, based on the final composition. A GU (glycine unit) is the amount of proteolytic enzyme which, under standard incubation conditions, produces an amount of terminal $NH_2$-groups equivalent to 1 microgram/ml of glycine. Naturally, mixtures of different proteolytic enzymes may be used in combination with other enzymes. Enzyme stabilizers, such as proteins, borate/propylene glycol, low levels of calcium, or carboxylates, optionally may be employed.

Optional components of the detergent formulations include, but are not limited to, ion exchangers, alkalies, anticorrosion materials, anti-redeposition materials, optical brighteners, fragrances, dyes, fillers, chelating agents, other enzymes, e.g., lipase(s), cellulases, oxidases, and amylase(s), fabric whiteners and brighteners, sudsing control agents, solvents, hydrotropes, bleaching agents, bleach precursors, buffering agents, soil removal agents, soil release agents, fabric softening agent and opacifiers.

These optional components may comprise up to about 90% of the detergent formulation. Examples of these optional components, commonly used surfactants and various builders are set forth in detail in U.S. Pat. No. 4,663,071 to Bush, issued May 5, 1987, and European Patent Application No. 0 344 828 to Berthod, et al., published Dec. 6, 1989, which are hereby incorporated by reference.

Examples of structured liquid detergent formulations in which the polymers disclosed herein may be employed as builders, alone or in combination with one or more co-builders, are set forth in detail in European Patent Application Nos. 0 301 882 to Bulfart, published Feb. 1, 1989, and 0 346 995 to Montague, et al., published Dec. 12, 1989, which are hereby incorporated by reference.

In a preferred embodiment, the polycarboxylate builder is incorporated into an isotropic liquid household laundry detergent formulation, comprising 5–85% surfactant(s), 0.1–55% builder(s), most preferably 0.1 to 20% builder, 0.05 to 50,000 GU/mg of one or more calcium-sensitive enzymes, and 15–95% of a combination of optional ingredients, such as buffers, other enzymes, softeners, antistatic agents, fluorescers, perfumes, water and fillers. The surfactant component may contain anionic, nonionic, cationic, zwitterionic or ampholytic surfactants, or any combination thereof. Neutralizing counterion(s) for the builders, such as sodium, potassium and monoethanolamine, may be employed. Combinations of counterions may be employed.

In isotropic liquid detergents, the monoethanolamine salt is preferred, particularly at a pH above 10 and at builder concentrations of 8% or more. At a pH of 10 or greater and at higher builder concentrations (e.g., 8–10% builder), monoethanolamine must be used for compatibility.

In a second preferred embodiment, any of the builder polymers disclosed herein are incorporated into a powdered household laundry detergent formulation, comprising 10–25% surfactant(s), 2–63% builder(s), 0.05 to 50,000 GU/mg calcium-sensitive enzymes, and 12–88% optional components, such as buffers, enzymes, softeners, antistatic agents, bleaches, optical brightners, perfumes, and fillers.

In a third preferred embodiment, any of the builder polymers disclosed herein are incorporated into a liquid or a powdered detergent formulation for use in automatic dishwashing machines, comprising from about 2–6% relatively low sudsing nonionic surfactant(s) (e.g., alkoxylation products of compounds containing at least one reactive hydrogen, such as BASF-Wyandotte Corporation's Pluronic ®, Tetronic ®, and Pluradot ® )1–65% builder(s), and 29–96% optional components, such as suds control agent(s) (e.g., mono- and distearyl acid phosphates), clay(s), bleach(es), alkali(es), fragrance(s), and filler(s).

Also useful herein are any detergent formulations, used commercially or experimentally, which employ a phosphate co-builder or phosphate-replacer builder or co-builder, or any builder which functions chiefly to sequester calcium, magnesium and other polyvalent cations present in hard water. Formulations employing mixtures of builders, including phosphate-containing mixtures, are also useful.

The detergent compositions of this invention may take any of the physical forms associated with detergent compositions, such as powders, granules, cakes and liquids. They may also be produced by any of the techniques commonly employed in the manufacture of detergent compositions, including slurry-making, extrusion and spray-drying processes for the manufacture of detergent powders. The builder may be incorporated in the slurry or blended with base powder. The practitioner will recognize which formulations are best suited to the physical form selected for a particular detergent composition and adjust the formulation accordingly.

HYDROPHOBICAILY-MODIFIED POLYCARBOXYLATES

The hydrophobically-modified polycarboxylate builders for use in these detergent compositions are interpolymers comprising repeating units of the structure:

$$\left[A-B\right]_m\left[C\right]_n$$

wherein m is a mole fraction from 0.70 to 0.95; n is a mole fraction from 0.05 to 0.30; A is derived from at least one ethylenically unsaturated carboxylic acid monomer; B is derived from at least one ethylenically unsaturated carboxylic acid monomer and B is not A; and C is:

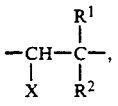

wherein X is —H,

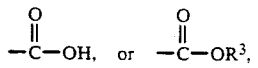

or a combination thereof, $R^1$ is —H, —$CH_3$, or —$(CH_2)_qCH_3$, or a combination thereof, and q is 1–5; $R^2$ is:

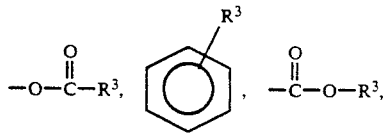

or $R^3$, or a combination thereof, and $R^3$ is a $C_8$–$C_{18}$ linear or branched alkyl chain; the interpolymer being prepared by polymerizing the monomers in a solvent system in which the monomers and interpolymer are soluble. A homogeneous interpolymer is provided by slowly adding the monomer from which C is derived to the carboxylic acid monomer(s) over a sufficient period of time to instantaneously and uniformly copolymerize the monomers.

The polycarboxylates preferred in detergents are polymers comprising repeating units of the structure:

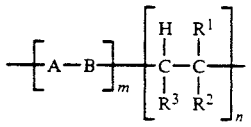

wherein A is derived from at least one ethylenically unsaturated mono- or di-carboxylic acid; B is derived from at least one ethylenically unsaturated mono- or di-carboxylic acid and B is not A;

$R^1$ is —H,—$CH_3$, or

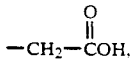

or a combination thereof; $R^2$ is

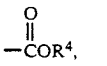

wherein $R^4$ is a $C_8$–$C_{18}$ linear or branched alkyl chain; $R^3$ is —H,—$CH_3$, or

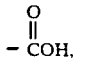

or a combination thereof; m is a mole fraction from 0.70 to 0.95; and n is a mole fraction from 0.05 to 0.30. For the purposes of this invention, the salt, acid, ester or anhydride form of the polymer, or a combination thereof, may be employed.

The molecular weight corresponding to 9 to 9,000 repeating units of the copolymers ranges from about 1,000 to 1,000,000. The ranges of the molecular weights of the copolymers are limited only by the solution method of preparation and the compatibility and effectiveness of the polymer as a builder. The corresponding number average molecular weight of the fully neutralized sodium salt of the copolymer ranges from about 1,200 to 1,200,000.

In a preferred embodiment the sodium carboxylate salt of the polymer is prepared by dissolving the anhydride in water and neutralizing it with sodium hydroxide. The practitioner will recognize that if the anhydride form of the polymer is incorporated into a detergent formulation, hydrolysis to the carboxylic acid form will occur under the alkaline conditions which are typical of formulating, washing or cleaning conditions. The sodium, potassium, ammonium, monoethanolamine or triethanolamine carboxylate salts of the polymer are preferred. Although the polyvalent cations responsible for water hardness are generally not employed, any organic or inorganic base or salt forming cation may be utilized in preparing the salt of the polymer.

In a second preferred embodiment, a $C_1$–$C_{12}$ alkyl or a $C_5$–$C_{12}$ cycloalkyl (having at least one five- or six-membered ring substituent) ester derivative of the moiety derived from the maleic anhydride (or acid) comonomer, is formed by reacting the polymer with an excess of $C_1$–$C_{12}$ alcohol. This reaction may be conducted in an aprotic solvent (e.g., toluene). Suitable alkyl esters may be prepared with any alkyl alcohol (e.g., lauryl alcohol); and suitable cycloalkyl esters may be prepared with any cycloalkyl alcohol (e.g., cyclohexanol).

Structure $\left[A—B\right]$ represents a repeating unit derived from at least two different copolymerizable carboxylic acid comonomers, preferably selected from the group consisting of vinyl esters of carboxylic acids, unsaturated carboxylic acids and unsaturated dicarboxylic acids and their anhydrides and esters. Structure A or B may consist of one or more of the selected comonomer(s). Certain of these comonomers (e.g., acrylic acid and maleic acid) are known to form homopolymers and copolymers which have commercial utility as powdered detergent builders (e.g., acrylic acid/maleic acid copolymer and polyacrylic acid). These builders generally are neither compatible nor stable in liquid detergent, particularily at higher builder concentration levels.

The carboxylic monomers useful in the production of the polymers of this invention are the olefinically unsaturated carboxylic acids containing at least one activated carbon-to-carbon olefinic double bond, and at least one readily functions in polymerization because of its presence in the monomer molecule either in the alpha-beta position with respect to a carboxyl group, or as a part of a terminal methylene grouping, olefinically-unsaturated acids of this class include such widely divergent materials as the acrylic acids typified by acrylic acid itself, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, citraconic acid, mesaconic acid, glutaconic acid, aconitic acid, maleic acid, fumaric acid, and tricarboxy ethylene. As used herein, the term "carboxylic acid" includes acids having more than one acid group, and those acid anhydrides, such as maleic anhydride, wherein the anhydride group is formed by the elimination of one molecule of water from two carboxyl groups located on the same polycarboxylic acid molecule.

Maleic anhydride and the other acid anhydrides useful herein may contain a substituent, such as hydrogen, halogen or hydroxyl or alkyl, aryl, alkaryl, aralkyl, and cycloalkyl groups, such as methyl, ethyl, propyl, octyl, decyl, phenyl, tolyl, xylyl benzyl, cyclohexyl, and the like. The preferred carboxylic monomers for use in this invention are the monoolefinic acrylic acids having an alpha substituent selected from the class consisting of hydrogen, halogen and hydroxyl groups, monovalent alkyl radicals, monovalent aryl radicals, monovalent aralkyl radicals, monovalent alkaryl radicals and monovalent cycloaliphatic radicals. Of this class, acrylic acid itself is most preferred because of its generally lower cost, ready availability, and ability to form superior polymers. Another particularly preferred carboxylic monomer is maleic anhydride.

Structure C represents a repeating unit derived from at least one ethylenically unsaturated monomer(s), having a $C_8$–$C_{18}$ linear or branched alkyl chain. The monomer(s) are selected from $C_8$–$C_{18}$ alkyl esters of ethylenically unsaturated carboxylic acid(s); $C_8$–$C_{18}$ is vinyl esters; $C_8$–$C_{18}$ substituted styrenes; and $C_8$–$C_{18}$ alpha-olefins; and mixtures thereof.

The preferred alkyl acrylate monomers having long chain aliphatic groups are derivatives Of acrylic acid represented by the formula:

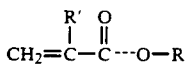

wherein R is a member of the class consisting of alkyl groups having from 8 to 18 carbon atoms, preferably 12 to 18 carbon atoms, and R′ is hydrogen or a methyl group. Representative higher alkyl acrylic esters are lauryl acrylate and stearyl acrylate, and the corresponding methacrylates. Mixtures of two or three or more long chain acrylic esters may be successfully polymerized with the carboxylic monomers, other alkyl esters, such as maleate esters, also may be employed.

Preferred vinyl esters of $C_8$–$C_{18}$ carboxylic acids include vinyl octanoate, vinyl dodecanoate, vinyl tetradecanoate, vinyl hexadecanoate and vinyl octadecanoate. Mixtures of these and/or other vinyl esters may be employed.

Preferred alpha-olefins include 1-octene, 1-nonene, 1-decanene, 1-dodecanene, 1-tetradecanene, 1-hexadecanene and I-octadecanene, and the like, and mixtures thereof. The practitioner will recognize that if C is derived from one or more alpha-olefins, the polymerization with comonomer(s) such as acrylic acid will only proceed in the presence of maleic anhydride.

The practitioner will recognize that although certain comonomers are selected for the preferred embodiments disclosed herein, any monomers within the selected class may be utilized. Furthermore small quantities of polyfunctional comonomers which are not within the selected classes may be utilized, provided that the resulting polycarboxylates retain their effectiveness as detergent builders. Examples Of such polyfunctional comonomers are acrylates and methacrylates of polyols, allyl and vinyl esters of polycarboxylic acids, divinyl benzene, and the like.

Other polycarboxylates, containing relatively minor amounts of one, two or more comonomer(s) in addition to the hydrophobe-containing and carboxylic acid comonomers, are intended to fall within the scope of this invention, provided that they do not render the polymer incompatible or ineffective as a detergent builder.

PREPARATION OF THE POLYCARBOXYLATES

The polycarboxylates herein are prepared by solution polymerization wherein the hydrophobic monomer is slowly added to the initial charge of one or more unsaturated carboxylate monomer(s). A substantially homogeneous interpolymer is provided by adding the hydrophobic monomer at a sufficiently slow rate such that copolymerization of the hydrophobic monomer is substantially instantaneous and uniform, and both the monomers and the interpolymer remain in solution.

The process for preparing the polycarboxylates comprises the steps:

a) providing an initial charge comprising up to 100%, by weight, of at least one monomer from which A or B is derived;

b) adding a charge comprising at least one monomer from which C is derived; and c) polymerizing the comonomers in solution in the presence of an initiator.

The process additionally may comprise the step of adding a charge of an ethylenically unsaturated carboxylic acid, such as acrylic acid, simultaneously with the charge of alkyl acrylate monomer to the unsaturated carboxylate monomer in the reaction vessel.

The process may further comprise the extraction of the polymer into an aqueous solvent, and/or the azeotropic removal of the solvent, or isolation of the polymer as a dry solid. The aqueous solution of the polymer may be spray-dried to yield polymer in dry form.

Any solvent or solvent system may be employed, provided the comonomers and polymer remain in solution at the ratios and percentages employed herein. A non-haloalkane solvent, such as toluene, is preferred.

Polymerization in solution is preferably carried out in the presence of a free radical catalyst in an open vessel under reflux at atmospheric pressure. However, the temperature may be varied from 350° C. to 1300° C., under nitrogen, with or without reflux. Polymerization under reflux at 110° to 120° C. under atmospheric pressure using a free radical catalyst is generally effective in bringing a polymer yield of 95% to 100% in less than 7 hours.

Suitable catalysts include peroxygen compounds such as caprylyl peroxide, benzoyl peroxide, hydrogen peroxide, pelargonyl peroxide, cumene hydroperoxides, tertiary butyl diperphthalate, tertiary butyl perbenzoate, sodium peracetate, sodium percarbonate, and the like as well as azo diisobutyryl nitrile, hereinafter referred to as azoisobutyronitrile. Other catalysts utilizable are the so-called "redox" type of catalyst and the heavy-metal activated catalyst systems. These polymers generally do not attain their maximum properties in water until converted to a partial alkali, ammonium or amine salt. The neutralizing agent is preferably a monovalent alkali such as sodium, potassium lithium or ammonium hydroxide or the carbonates and bicarbonates thereof, or mixtures of the same, and also amine bases having not more than one primary or secondary amino group.

In a preferred embodiment for small scale polymerization (e.g., 2 liter vessel) the initial charge is a mixture of maleic anhydride and toluene; the added charge is a mixture of acrylic acid and lauryl methacrylate in toluene which is added over a period from 3 to 4 hours; the temperature is 110° to 120° C.; and the polymerization is carried out under reflux. The weight average molecular weight of the interpolymer is typically about 3,000 to 15,000, and preferably less than 20,000. The practioner will recognize that larger, commercial scale polymerization requirements often vary from those of small scale ones, and variables, such as time of addition of monomer(s), total reaction time, amount and type of initiator, temperature, and the like, will be varied to achieve optimum conditions.

This invention is illustrated by the following examples.

EXAMPLE 1

This example illustrates the preparation of the maleic acid/acrylic acid/lauryl methacrylate and stearyl methacrylate terpolymers of this invention.

A. Preparation of MA/AA/LMA terpolymer

A 2 liter, 4-necked flask was equipped with a mechanical stirrer, condenser, nitrogen inlet, addition funnels and thermometer. Maleic anhydride (49.05 g, 500 mmol) was dissolved in 325 mL of toluene, charged to the flask, and heated to reflux. Appropriate amounts of acrylic acid and lauryl methacrylate (see Table I) were dissolved in 70 mL of toluene and charged to the flask through an addition funnel over a 3 hour period. During this time, the polymerization mixture was maintained under reflux while a mixture of benzoyl peroxide (2.4 g; 10 mmol) in 50 mL of toluene was slowly added with stirring over a period of 5 hours. The reaction was permitted to continue for 2 hours at reflux and then a sample was taken to check for residual monomer. A mixture of benzoyl peroxide (2.4 g; 10 mmol) in 50 ML of toluene was added over a 3 hour period and the reaction was refluxed an additional 2 hours. When the polymerization was complete the toluene solution of the terpolymer was transferred to an addition funnel on a 4-necked, 5 liter flask equipped with a mechanical stirrer, condenser, Dean-Stark trap, and heating mantle. Water (750 mi) was charged to the flask and brought to reflux. The polymerization solution was slowly added to refluxing water with simultaneous steam injection to remove residue toluene and the pH was adjusted to 7.0. No residual lauryl methacrylate was detected in the product. Molecular weights were measured by gel permeation chromatography against sulfonated polystyrene standards in aqueous mobile phase.

The amounts of acrylic acid and lauryl methacrylate monomers employed herein are listed in Table I. The mole % hydrophobic monomer contents were 5, 10 and 15% for samples A, B and C respectively. Molecular weight characteristics of the terpolymers prepared from these monomers are listed in Table I.

B. Preparation of MA/AA/SMA terpolymers

The terpolymers were prepared by the same method as the terpolymers of Part "A" above except that different amounts of hydrophobic monomer (see Table I) were employed, and stearyl methacrylate was substituted for lauryl methacrylate. No residual stearyl methacrylate was detected in the product.

TABLE I

MA/AA/Hydrophobe Terpolymers

| Mole Ratio MA/AA/H[a] | Hydrophobic Monomer | g of Hydrophobic Monomer | g of Acrylic Acid | Molecular Weight Weight Average | Molecular Weight Number Average |
|---|---|---|---|---|---|
| 5/9.25/.75 | A. Lauryl Methacrylate | 19.1 | 66.7 | 8,400 | 3,220 |
| 5/8.5/1.5 | B. Lauryl Methacrylate | 38.2 | 61.3 | 8,490 | 3,060 |
| 5/7.75/2.25 | C. Lauryl Methacrylate | 57.2 | 55.8 | 9,300 | 3,200 |
| 5/9.25/.75 | D. Stearyl Methacrylate | 25.4 | 66.7 | — | — |
| 5/8.5/1.5 | E. Stearyl Methacrylate | 50.8 | 61.3 | — | — |
| 5/7.75/2.25 | F. Stearyl Methacrylate | 76.2 | 55.8 | — | — |

[a]MA/AA/H = Maleic anhydride/acrylic acid/hydrophobic monomer.

EXAMPLE 2

This example illustrates the capacity of the polycarboxylate terpolymers of Example 1 for calcium sequestration.

Aliquots of solutions containing 0.1, 0.2, 0.3 or 0.4 g/l of the experimental and control polymers were each treated with solutions of calcium chloride in water, containing, respectively, 60 and 120 ppm calcium ion. A calcium ion selective electrode (Radiometer 2002 Calcium Selectrode, Radiometer A/S, Copenhagen, Denmark) was used to measure the free calcium ion concentration of the treated solutions.

The detergent builders tested for calcium ion sequestration included the terpolymers A–F of Example 1 and Sokalan ® CP-7 (a trademark registered to BASF Corporation and used in connection with a copolymer of acrylic acid and maleic acid that is used commercially as a detergent builder in powdered detergents).

Results expressed as pea are set forth in Table II and FIG. 1. All treatments resulted in higher pea (indicating lower concentration of free calcium ion remained in solution following treatment) as the treatment level was increased. Overall, the terpolymers A–F effectively sequestered calcium ions. The Sokalan ® CP-7 builder was more effective at the higher polymer concentrations which were tested.

TABLE II

Calcium Sequestration at 60 ppm and 120 ppm calcium ion

| Builder[a] | Calcium ion ppm | pCa Treatment Level (g/l) 0.1 | 0.2 | 0.3 | 0.4 |
|---|---|---|---|---|---|
| Sokalan ® | 60 | 3.74 | 5.10 | 6.21 | 6.73 |
| CP-7 | 120 | 3.00 | 3.43 | 4.23 | 4.98 |
| Terpolymer | 60 | 3.52 | 4.26 | 5.10 | 6.16 |
| A (Lauryl) | 120 | 2.92 | 3.20 | 3.63 | 4.62 |
| Terpolymer | 60 | 3.55 | 4.31 | 5.24 | 5.91 |
| B (Lauryl) | 120 | 2.93 | 3.21 | 3.60 | 4.53 |
| Terpolymer | 60 | 3.58 | 4.42 | 5.39 | 5.97 |
| C (Lauryl) | 120 | 2.94 | 3.23 | 3.63 | 4.25 |
| Terpolymer | 60 | 3.58 | 4.23 | 5.14 | 5.63 |

TABLE II-continued

| Calcium Sequestration at 60 ppm and 120 ppm calcium ion | | | | | |
|---|---|---|---|---|---|
| | Calcium ion | pCa Treatment Level (g/l) | | | |
| Builder[a] | ppm | 0.1 | 0.2 | 0.3 | 0.4 |
| D (Stearyl) | 120 | 2.95 | 3.18 | 3.54 | 4.01 |
| Terpolymer | 60 | 3.51 | 4.21 | 5.18 | 5.75 |
| E (Stearyl) | 120 | 2.91 | 3.14 | 3.53 | 3.95 |
| Terpolymer | 60 | 3.53 | 4.19 | 5.16 | 5.74 |
| F (Stearyl) | 120 | 2.89 | 3.12 | 3.40 | 3.82 |

[a]Terpolymers were in sodium salt form.

Results also are shown in FIG. 1 which graphically illustrates the relative calcium ion sequestration capacity of the terpolymers over a range of polymer treatment levels at 120 ppm calcium ion.

EXAMPLE 3

This example illustrates the preparation of liquid household laundry detergent compositions employing the builders disclosed herein.

Liquid detergent compositions for household laundry use are prepared according to the following formulations:

TABLE III

| Liquid Laundry Detergents | | | | | | |
|---|---|---|---|---|---|---|
| Component | % by Weight in Formulation | | | | | |
| Formula No: | 1 | 2 | 3 | 4 | 5 | 6 |
| Actives | | | | | | |
| Sodium $C_{11}$-$C_{15}$ Alkylbenazene Sulfonate | 8 | 17 | 10 | | | 7 |
| Alcohol Ethoxy Sulfate[a] | 12 | | 6 | | | 1 |
| Alcohol Ethoxylate[b] | 8 | 7 | 8 | 16 | 8 | 4 |
| Alkylpolyglycoside[c] | | | | | 16 | 15 |
| Builders | | | | | | |
| Trisodium Citrate | 0–15 | 0–15 | 0–10 | 0–20 | 10 | 10 |
| Soap | 0–10 | 0–15 | | | 5 | 4 |
| Carboxymethyloxy-succinate, trisodium | | | | | 10 | 0–20 |
| Oxydisuccinate, tetrasodium | | | | | | 6 |
| MA/AA/Hydrophobe terpolymers[f] | 5–15 | 2–20 | 2–15 | 1–10 | 5 | 2–15 |
| Buffers | | | | | | |
| Monoethanolamine | 1 | 2 | 2 | 0–4 | | 2 |
| Triethanolamine | | | 2 | | 4 | 4 |
| Sodium Carbonate | | | | | | 1 |
| Enzymes | | | | | | |
| Protease (Savinase, Alcalase, etc.) | 1 | — | 1 | 0.5 | 1 | 0.75 |
| Amylase (Termamyl) | 0.5 | — | — | 0.5 | 1 | 0.5 |
| Lipase (Lipolase) | 1 | — | — | 0.5 | 1 | 1 |
| Enzyme Stabilizers | | | | | | |
| Borax Pentahydrate | | | 3.5 | | 4 | 4 |
| Glycerol | | | 4 | | 6 | 5 |
| Propylene Glycol | 10 | | | 10 | 2 | 5 |
| Formic Acid | 1 | | | 1 | | 1 |
| Calcium Chloride | 1 | | 1 | 1 | 1 | 1 |
| Softeners & Antistats | | | | | | |
| Quaternary Amines (Arquad 2HT) | | | | 2 | | |
| Ethoxylated Amine[d] | 1 | | | 2 | 1 | |
| Alkyldimesthyl Amine Oxide[e] | | | | 1.5 | | |
| Compatibilizing Agents | | | | | | |
| Na Xylene Sulfonates | 3 | 6 | 3 | 2 | | 3 |
| Ethanol | 10 | | 2 | 8 | 3 | 3 |
| Fluorescers Tinopal UNPA | 0.25 | 0.2 | 0.25 | 0.25 | 0.2 | 0.15 |
| Perfume | 0.2 | 0.15 | 0.1–0.3 | 0.2 | 0.25 | 0.1–0.25 |

TABLE III-continued

| Liquid Laundry Detergents | | | | | | |
|---|---|---|---|---|---|---|
| Component | % by Weight in Formulation | | | | | |
| Formula No: | 1 | 2 | 3 | 4 | 5 | 6 |
| Water | To Balance | | | | | |

[a]Sulfated Alfonic ® 1412-60 (12–14 C alcohol ethoxylate, containing 60% ethylene oxide by weight, sodium salt.)
[b]Alfonic ® 1412-70 (12–14 C alcohol) ethoxylate.
[c]APG 300 (obtained from Horizon Chemical).
[d]Varonic ® U202 (obtained from Sherex Corporation).
[e]Ammonyx MO (obtained from Stepan Chemical).
[f]See, e.g., Example 1 for preparation and description of terpolymers.

EXAMPLE 4

This example demonstrates the compatibility and stability of the terpolymers in liquid detergent formulations, and terpolymer stability upon storage.

The compatibility and stability of the terpolymers listed in Table I, above, were evaluated in liquid detergent formulation "2" of Example 3. The formulations were blended and the compatibility was determined by visual observation, initially and after storage. Builders which were not compatible became hazy, precipitated or separated into different phases. Compatible builders remained in a clear, dispersed state. Unstable builders lost compatibility upon storage. The results of compatibility tests are shown in Table IV.

The results show that the terpolymers are compatible and stable in a typical liquid detergent formulation.

TABLE IV

| Liquid Detergent Compatibility[c] | | | |
|---|---|---|---|
| | % in | Observations | |
| Builder[b] | Formulation[a] | Initial | 30 days[d] |
| Terpolymer | 4 | phased | — |
| A (5% lauryl) | 8 | phased | — |
| Terpolymer | 4 | clear | stable[e] |
| B (10% lauryl) | 8 | clear, very viscous (solid) | — |
| Terpolymer | 4 | clear | stable[e] |
| C (15% lauryl) | 8 | clear | — |
| Terpolymer | 4 | phased | — |
| D (5% stearyl) | 8 | phased | — |
| Terpolymer | 4 | clear | stable[e] |
| E (10% stearyl) | 8 | — | — |
| Terpolymer | 4 | phased | — |
| Terpolymer | 4 | phased | — |
| Terpolymer | 4 | hazy | stable[e] |
| F (15% stearyl) | 8 | phased | — |

[a]Detergent formulation No. "2" of Example 3.
[b]Terpolymers were prepared by method of Example 1 and are described in Table I.
[c]Compatibility was measured at pH = 8.0.
[d]Detergents were stored at 50° C. for 30 days.
[3]Samples also were subjected to 3 freeze-thaw cycles. Some separation was observed after th. second cycle, but terpolymers were easily returned to a clear solution and did not separate again.

To measure the stability of the ester moieties, aqueous solutions of the terpolymers were adjusted for pH by the addition of a base and stored at 50° C. for 30 days. At the end of the 30 day test period, the pH of the solution was rechecked. The solution was analyzed for alcohol hydrolysis fragments resulting from possible hydrolysis of the ester moieties. The results indicate that even at pH 11–12 and 50° C. for 30 days, a maximum of 4% of the ester groups were hydrolyzed. See Table V for results.

TABLE V

| Terpolymer Solutions[a] | Terpolymer Stability[b] Base[c] | pH Initial | pH Final[d] | Observations[d] % Hydrolysis |
|---|---|---|---|---|
| Terpolymer B (10% lauryl) 13.5% solids | NaOH | 12.0 | 10.73 | 0.1%[e] |
| | Monoethanol-amine | 11.0 | 11.0 | 2.0% |
| Terpolymer C (15% lauryl) 7.6% solids | NaOH | 12.0 | 11.31 | 0.2%[f] |
| | Monoethanol-amine | 11.0 | 11.0 | 4.0% |
| Terpolymer E (10% stearyl) 7.5% solids | NaOH | 12.0 | — | Sl. turbidity |
| Terpolymer F (15% stearyl) 3.1% solids | NaOH | 12.0 | — | Sl. turbidity |

[a]Terpolymers were prepared by method of Example 1 and are described in Table I.
[b]Terpolymer stability was tested in aqueous solutions of terpolymer.
[c]Terpolymer containing solutions were initially adjusted to pH = 12.0.
[d]After storage at 50° C. for 30 days.
[e]After storage, sample contained 25 ug/ml lauryl alcohol.
[f]After storage, sample contained 100 ug/ml lauryl alcohol.

EXAMPLE 5

This example illustrates that the process herein provides optimum builder calcium binding properties and detergent compatibility.

A. Preparation of Polymer

Maleic acid/acrylic acid/lauryl methacrylate polymers were prepared according to Example 1, Part A, above, except that the initial monomer charge and the rates of additional monomer charges were varied as set forth in Table VI.

As shown in Table VI, the hydrophobic monomer was slowly added to the reaction vessel over a period from 2 to 4.5 hours. Where all of the maleic acid was initially charged to the reaction vessel, acrylic acid was added slowly over a period from 2 to 4.5 hours. If a portion or all of the maleic acid was withheld from the vessel, a mixture of the withheld maleic acid and acrylic acid was added slowly over 2 to 4 hours.

TABLE VI

| Builder Sample | % MA in Initial Charge | Hours of Slow Addition/Charge: AA/MA | AA | LMA | Calcium Binding pKCa[a] | Compatibility Surfactant Blend[b] 1 | 2 | 3 | 4 | 5 | 6 |
|---|---|---|---|---|---|---|---|---|---|---|---|
| Sokalan ® CP5 | Control | | | | 6.35 | N | N | N | N | N | N |
| Sokalan ® CP7[e] | Control | | | | 7.12 | — | — | — | — | — | — |
| Sodium Citrate | Control | | | | 3.62 | | | | | | |
| 49A | 100 | — | 2 | 4 | 6.38 | N | | | N | | |
| 49B | 100 | — | 4 | 4 | 6.70 | | | | | | N |
| 49C | 50 | 3 | — | 3 | 6.73 | N | N | N | N | N | |
| 51A | 0 | 2 | — | 4 | 6.33 | | | | N | N | |
| 51B | 0 | 4 | — | 4 | 6.30 | | | | | | |
| 51C | 50 | 3 | — | 3 | 6.70 | | | | | | |
| 53A | 0 | 2 | — | 2 | 7.02 | | | | | | N |
| 53B | 100 | — | 2 | 2 | 6.52 | | | | | | |
| 53C | 50 | 3 | — | 3 | 6.59 | | | | | | |
| 57A | 0 | 4 | — | 2 | 6.41 | | | | | N | |
| 57B | 100 | — | 4 | 2 | 6.50 | | | N | | | |
| 57C | 50 | 3 | — | 3 | 6.60 | | | | | | |
| 49A-2[c] | 100 | — | 2 | 4 | 7.40 | | | | N | | |
| 51A-2[c] | 0 | 2 | — | 4 | 7.04 | | | | | | |
| 62A[d] | 100 | — | 3 | 3 | 6.47 | N | | | | | |
| 63A | 100 | — | 3 | 3 | 5.89 | | | | | | |
| 77A | 100 | — | 3.5 | 3.5 | 6.30 | | | | | | |
| 77B | 100 | — | 4.5 | 4.5 | 6.43 | | | | | | |
| 81A | 66.7 | 3.25 | — | 3 | 6.16 | | | | | | |
| 81B | 88.3 | 3.5 | — | 3 | 6.32 | N | | | | | |
| 81C | 100 | 4 | — | 3 | 6.43 | | | | | | |

[a]pKCa is the intrinsic calcium binding constant, i.e., the equilibrium constant for the polymercalcium complex extrapolated to zero occupied binding sites.
[b]See Table VII. Builders were not compatible in blends marked "N". All other builders were compatible.
[c]Duplicate samples of 49A and 51B, respectively.
[d]Sample 62A was prepared by the method of Example 1, employing 10% lauryl methacrylate (corresponding to Sample "B" Table I.)
[e]Not tested for compatibility.

B. Calcium Sequestration Testing

The terpolymers of Part A, above, were tested for calcium sequestration employing a calcium ion selective electrode (Corning Radiometer F2110 Calcium Selective Electrode). Terpolymer solutions containing 100 mg terpolymer (or Sokalan ® or citrate control) and 117 mg sodium chloride in 100 ml of water were adjusted to a pH of 10.5 with ammonium hydroxide, and were treated with calcium ion solution (0.1 M calcium) to 3 treatment levels (to a pea of 4, 4.5 or 5.0). The calcium treatment was carried out with agitation at room temperature by adding 0.2 mL of the calcium ion solution every two minutes for a total of eight minutes. Calcium ion concentration readings were taken just prior to the addition of each aliquot to determine when sufficient calcium ion solution had been added to reach a pea of 4.0, 4.5 or 5.0. The pKCa (i.e., intrinsic binding constant) for each terpolymer and the control was calculated from a plot of the electrode readings, wherein PCa+log $$\left(\frac{Z}{1-Z}\right)$$

was plotted on the Y-axis and Z was plotted on the X-axis. The pKCa is the Y-intercept, extrapolated from the linear portion of the curve; pea is the negative logarithm of the free calcium ion concentration; and Z is the fraction of occupied binding sites on the terpolymer and the controls. Results are shown in Table VI as the pKCa. As the pKCa increases, and as total calcium sequestration capacity of the terpolymer increases, the effectiveness of the terpolymer as a builder increases.

Figure 2:
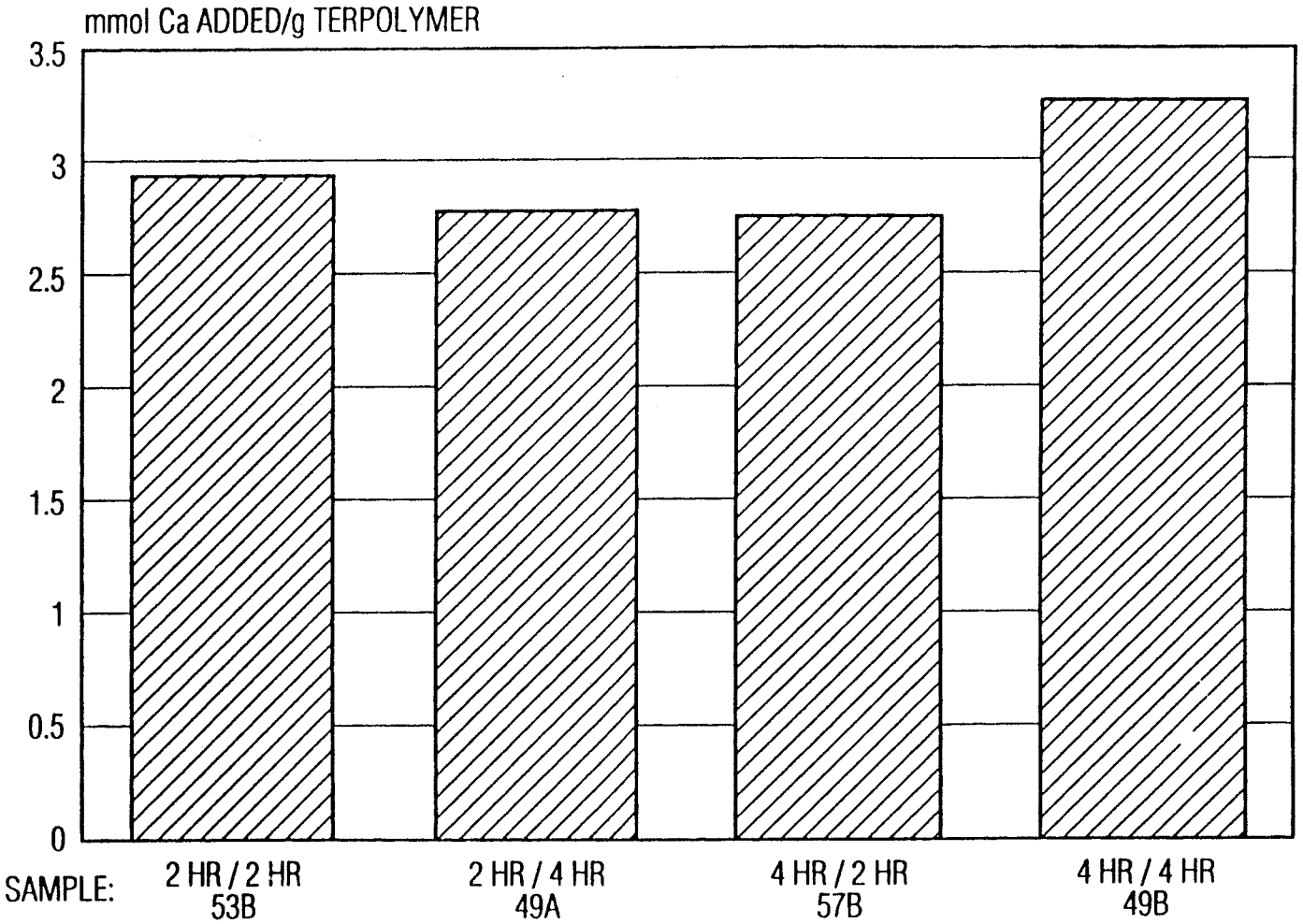
FIGS. 2–4 are derived from Example 5 and Table VI, herein. In the figures, "2 hr/2 hr" refers to addition times for acrylic acid/lauryl methacrylate monomer charges.
Figure 3:
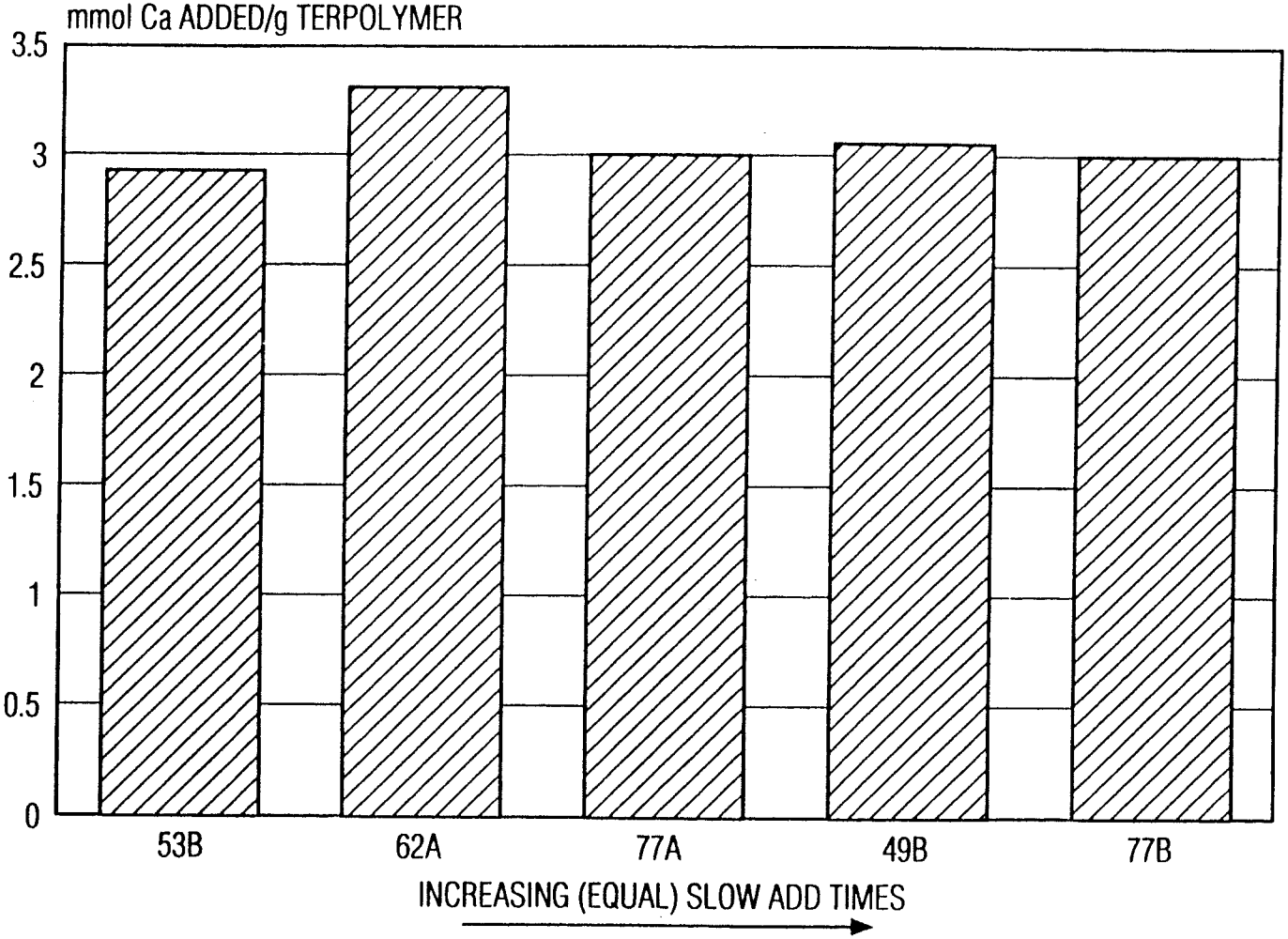
Figure 4:
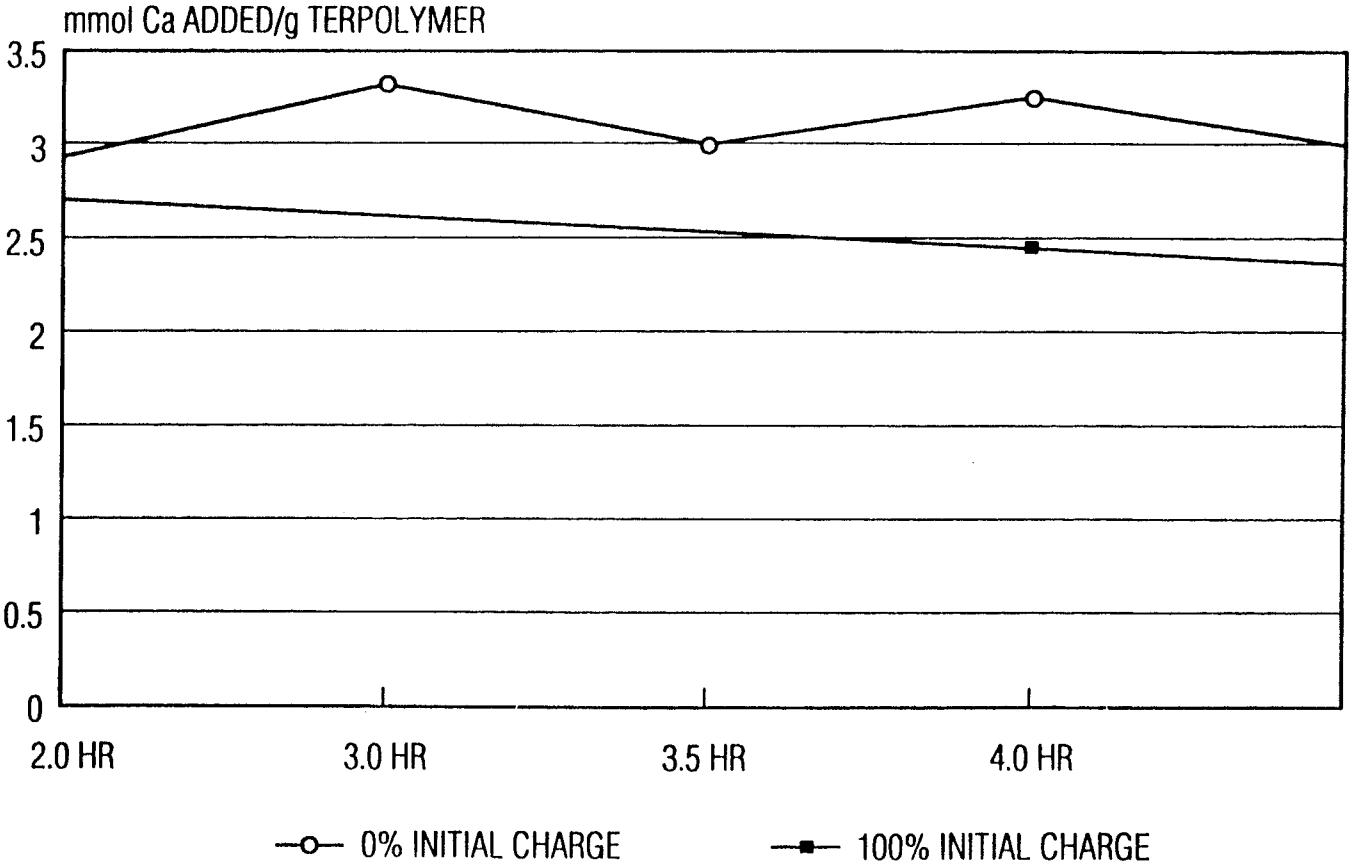

Total sequestration capacities for the terpolymers, expressed as the amount of calcium ion added/gram of terpolymer to reach a pea of 4.5, is shown in FIGS. 2 to 4 for a variety of process variables.

All processes employed in this example produced polymers having acceptable pKCas (i.e., greater than 6.00), which were significantly better than the citrate control (pKCa=3.62) and comparable to the Sokalan ® controls (pKCas=6.35 and 7.12). However, the total calcium binding capacity varied with the process used for polymerization.

The optimum total calcium binding properties were observed where both the carboxylic acid monomer(s) and the hydrophic monomer were each added over an equal period of time, preferably over a 3–4 hour period, and where all of the maleic acid monomer was contained in the initial charge.

C. Liquid Detergent Compatibility Testing

The polymers prepared by the methods of Part A, above, were tested at 5% by weight in the surfactant blends listed in Table VII, below. The blends each contained 24%, by weight, surfactant, with the balance being water.

TABLE VII

| Surfactant Blend | Sodium $C_{11}$-$C_{15}$ Alkylbenzene Sulfonate | Neodol ® 25-9[a] | Neodol ® 25-3S[b] |
|---|---|---|---|
| 1 | 10 | 8 | 6 |
| 2 | 6 | 12 | 6 |
| 3 | 10 | 4 | 10 |
| 4 | 16 | 8 | 0 |
| 5 | 12 | 6 | 6 |
| 6 | 6 | 6 | 12 |

[a]A registered trademark of Shell Chemical Company, Houston, Texas.
[b]A registered trademark of Shell Chemical Company, Houston, Texas.

Results are shown in Table VI. A "N" indicates that the builder was not compatible with the surfactant blend. The Sokalan ® CP5 control was not compatible. The citrate control and polymers 51A, 77A, 77B, 81A and 81C were compatible in all surfactant blends. Polymers 81B, 62A, 49A-2, 57A, 53A and 49B were compatible in five of the six blends. Thus, slow addition (over at least two hours) over an equal period of time of the hydrophobic monomer and the carboxylic acid monomer to an initial charge of 100% of the maleic anhydride provided the optimum detergent compatibility.

EXAMPLE 6

This example illustrates that the process employed herein provides unique builder compatibility in liquid detergent formulations.

A. Preparation of MA/AA/LMA terpolymers

An 85% MA/AA (1.0:2.0 molar ratio):15% lauryl methacrylate terpolymer was prepared by an aqueous polymerization technique for comparison with the terpolymers prepared by the process of this invention.

In the aqueous polymerization process, deionized water (250 g) and maleic anhydride (147 g) were charged to a 2 liter reaction vessel equipped with a stirrer, thermometer and condenser with stirring. Sodium hydroxide (60 g) was dissolved in deionized water (125 g) and added to the reaction vessel. Isopropanol (250 g) was added to the vessel and heated to reflux. A mixture of acrylic acid (216 g) and lauryl methacrylate (212 g) was fed into the vessel over three hours. A catalytic feed of sodium persulfate (18 g) in deionized water (100 g) was added simultaneously over three and a half hours.

The contents of the vessel were held at reflux for one hour. The isopropanol was removed azeotropically under reduced pressure (365 g of distillate collected). Cooling deionized water (325 g) and 48% sodium hydroxide (325 g) were added to give 1850 g of 40% polymer at pH=7.0. The polymer had an average molecular weight of 3750 and an average molecular number of 1050. The polymer contained 0.62% residual maleic anhydride and 0.05% residual lauryl methacrylate.

B. Liquid Detergent Compatibility Test

At 4% of detergent formulation "2", Table III above, the terpolymer of part "A", above, precipitated from the formulation. A control containing 5% of terpolymer B of Example 1, Table I, remained clear. The terpolymer of part "A" was not compatible with any of the surfactant blends listed in Table VII. Thus, the process set forth in Example 1 unexpectedly provides unique terpolymers which are compatible in liquid detergent formulations.

EXAMPLE 7

This example illustrates the preparation and detergency of household laundry detergent compositions employing a variety of builders as controls and terpolymer 77B of Table VI, Example 5 as an experimental builder.

Liquid detergent compositions suitable for use as household laundry detergent were prepared according to the following formulation:

| Component | % by Weight in Formulation |
|---|---|
| Sodium Alkylbenzene Sulfonate (C11.5) | 10.0 |
| Neodol 25-9 | 8.0 |
| Neodol 25-3S | 6.0 |
| Sodium Xylene Sulfonate | 3.0 |
| Monoethanolamine | 2.0 |
| Triethanolamine | 2.0 |
| Sodium Borate Decahydrate | 2.7 |
| Propylene Olycol | 4.0 |
| Builder | 0–20 |
| Sodium Hydroxide | to pH 10 |
| Water | to 100% |

Detergency evaluations were conducted in a Terg-O-tometer (US Testing Company) employing detergency monitor cloths sold by Test Fabrics Company. Fatty/particulate soiled cloths were used. Water hardness was adjusted to 60, 120, or 180 ppm polyvalent cations (calculated as calcium carbonate; 2:1 ratio ration of $Ca^{++}$:$Mg^{++}$). Water at the appropriate hardness was first added to the Terg-O-tometer beaker. The appropriate amounts of the detergent formulation wall then added to make one liter of detergent having a total concentration of 2.0 g/l.

Builders were dosed at the appropriate level into the wash liquor. After the test solution reached the desired wash temperature (400° C.), the detergency monitor cloths were introduced (4–8 cloths per beaker) and the wash cycle begun (100 rpm). After washing 15 minutes, the cloths were rinsed for 1 minute, dried, and their reflectances were recorded using a Gardner reflectometer (Model Colorguard System 05). Using the reflectances of the soiled and washed cloths, ΔR was calculated according to the following relationship:

$$\Delta R = R_{washed} - R_{soiled}$$

As the effectiveness of the detergent formulation improves, the ΔR value increases.

As the percent builder increased (from 0% to 5, 10, 15 and 20%), the ΔR increased for all controls and the terpolymer disclosed herein. At all percentages, the terpolymer builder was superior to the citrate builder and equivalent to the oxydisuccinate and Sokalan@CP7 builders in detergency.

The detergency results at 0 and 10% builder are given in Table VIII for the fatty/particulate cloths at three water hardnesses. It is clear from these results that the polymer of this invention provides substantial detergency building across all water hardnesses. They are similar in effectiveness to oxydisuccinate and Sokalan ® CP7, and superior to sodium citrate.

TABLE VIII

| | Builder Detergency in Model Formulation[a] Δ R Values | | | |
|---|---|---|---|---|
| ppm 2:1 Ca++:Mg++ | Oxydi-succinate | Terpolymer[b] | Citrate | Sokalan ® CP7 |
| Control | 18.6 | 18.6 | 18.6 | 18.6 |
| 60 ppm | 22.0 | 21.4 | 19.7 | 20.6 |
| Control | 14.3 | 14.3 | 14.3 | 14.3 |
| 120 ppm | 20.1 | 18.8 | 17.4 | 21.4 |
| Control | 14.7 | 14.7 | 14.7 | 14.7 |
| 180 ppm | 17.4 | 14.8 | 13.4 | 18.4 |

[a]Formulation contained 10% builder.
[b]Acrylate/maleate/lauryl methacrylate terpolymer (77B of Tabl3 VI, Example 5) prepared by the method of Example 1.

EXAMPLE 8

This example illustrates the preparation of representative, powdered detergent compositions for general cleaning which employ the builders disclosed herein.

Household detergent compositions for general cleaning use are prepared according to the following formulations:

TABLE IX

| Component | % by Weight in Formulation | | | | | |
|---|---|---|---|---|---|---|
| Formula No: | 1 | 2 | 3 | 4 | 5 | 6 |
| Actives | | | | | | |
| Sodium $C_{11}$-$C_{13}$ Alkylbenzenae Sulfonate | 11 | 11.5 | 7 | 11 | 15 | |
| Alcohol Ethoxy Sulfate[a] | | 5.5 | | | | |
| Primary Alcohol Sulfate | 10 | | | 9 | 5 | |
| Alcohol Ethoxylate[b] | | 3 | | 2 | 3 | 10 |
| Soap | 1 | | | | 1 | |
| Builders | | | | | | |
| Sodium Tripolyphosphate | | | | | 25 | |
| Aluminosilicates, e.g., Zeolite 4A | 10–35 | 0–15 | 5–20 | 0–12 | | |
| Polycarboxylate, e.g., CP-5 | 0–3 | | | | | |
| MA/AA/Hydrophobe terpolymers[d] | 2–25 | 2–25 | 2–25 | 2–25 | 5 | 2–20 |
| Buffers | | | | | | |
| Alkaline Silicate | 2–5 | 20 | 5 | 3–20 | 15 | 15 |
| Sodium Carbonate | 18 | 18 | 15 | 30 | 20 | 40 |
| Enzymes | | | | | | |
| Protease (Savinase, Alcalase, etc.) | 0.5 | 0–1 | 0.5 | 0.5 | 1 | 1 |
| Amylase (Termamyl) | 0.4 | | | 0.5 | 0.5 | |
| Lipase (Lipolase) | 1.0 | 0–1 | | 0.5 | 1 | 1 |
| Softeners & Antistats | | | | | | |

TABLE IX-continued

| Component | % by Weight in Formulation | | | | | |
|---|---|---|---|---|---|---|
| Formula No: | 1 | 2 | 3 | 4 | 5 | 6 |
| Quaternary Amines (Arquad 2HT) | | | 2.4 | | | |
| Ethoxylated Amine[c] | | | 2 | | | |
| Swelling Clay | | | 10 | | | |
| Fluorescers Tinopal AMS | 0.15 | 0.2 | 0.25 | 0.15 | 1.5 | 1.5 |
| Perfume | 0.1 | 0.2 | 0.1 | 0.1 | 0.1 | 0.1 |
| Fillers Na Sulfate | | | To Balance | | | |

[a]Sulfated Alfonic ® 1412-70.
[b]Neodol ® 25-9 (12-15C alcohol, 9 mole ethylene oxide condensate).
[c]Varonic ® U202 (obtained from Sherex Corporation).
[d]Terpolymers are prepared by the method of Example 1 and are described in Table I.

EXAMPLE 9

This example illustrates the effect of builder selection on enzyme stability in a heavy duty liquid (HDL) detergent composition.

The following detergent composition was prepared and evaluated for enzyme stability at 37° C. employing the builders listed in Table X.

| Component | % by Weight in Formulation |
|---|---|
| sodium alkyl benzene sulfonate | 10.0 |
| Neodol 25-9 | 8.0 |
| sodium alkyl ether sulfate | 6.0 |
| propylene glycol | 4.0 |
| sodium borate | 2.7 |
| sodium xylene sulfonate | 3.0 |
| monoethanolamine | 2.0 |
| triethanolamine | 2.0 |
| Tinopal UNPA[c] | 0.25 |
| calcium chloride | 0.0287 |
| sodium stearate | 0.0816 |
| Savinase[b] | 0.375 |
| Builder[a] | 7.0 |
| sodium hydroxide | to pH = 10 |
| water | to 100% |

[a]See Table X below.
[b]A protease enzyme.
[c]Flouescor

Figure 5:
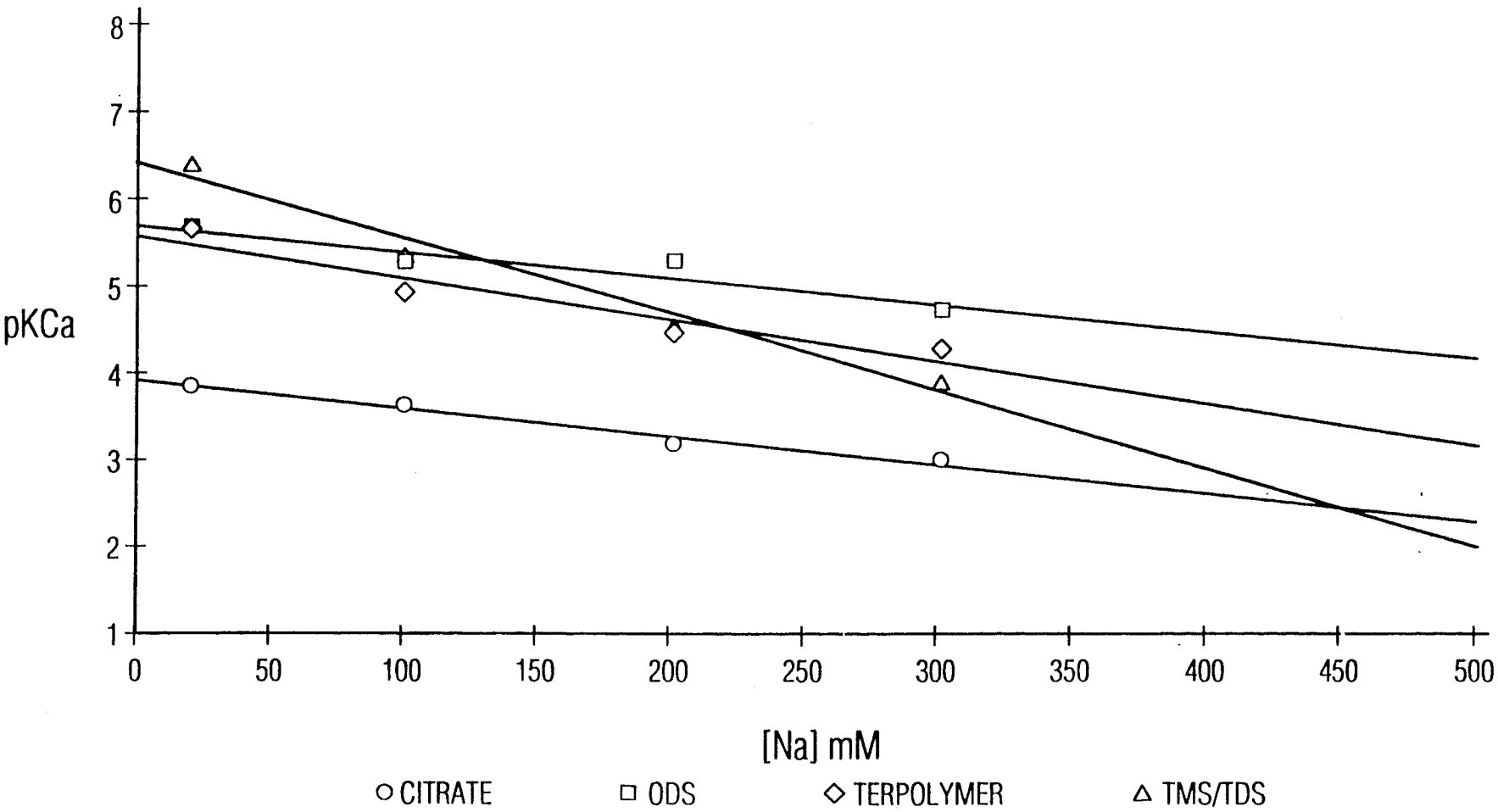
FIG. 5 is derived from Example 9, herein, and it illustrates the relationship between the intrinsic binding constants for calcium (pKCa) of several builders and the ionic strength of the builder solution.

The detergent compositions were tested for enzyme stability by measuring the protease activity (tetrapeptide method) as a function of time of storage at 37° C. Half-lives were determined by plotting $\ln[A_o/A_t]$ versus time (where $A_o$=initial activity and $A_t$=activity at time t) and performing a linear regression. The number of days needed to reach protease half-life activity for the detergent compositions is set forth in Table X and expressed as $t_{\frac{1}{2}}$ (days at 37° C.). Also set forth in Table X is the pKCa for the builders used in these detergent formulations. The pKCa was determined by the method of Example 5 at different ionic strengths and plotted in FIG. 5.

TABLE X

EFFECT OF BUILDERS ON ENZYME STABILITY

| BUILDER | $t_{\frac{1}{2}}$ (DAYS E 37° C.) | pKCa |
|---|---|---|
| None | >30 | — |
| Sodium Citrate | >30 | 3.8 |
| Oxydisuccinate (ODS) | 10 | 5.6 |
| Tartrate Monosuccinate/Disuccinate (TMS/TDS) | 8 | 5.6 |

TABLE X-continued

EFFECT OF BUILDERS ON ENZYME STABILITY

| BUILDER | $t_{\frac{1}{2}}$ (DAYS E 37° C.) | pKCa |
|---|---|---|
| Polycarboxylate Terpolymer[a] | >30 | 6.4 |

[a]Terpolymer was prepared by the method of Example 5 and it corresponds to Sample 62A, Table VI. in selection of processing variables. The terpolymer comprises 15 mole % lauryl methacrylate.

The results surprisingly demonstrate good enzyme stability (more than 30 days) in the presence of a polycarboxylate terpolymer builder which has excellent calcium binding properties. The other builders having excellent calcium binding properties, ODS and TMS/TDS, adversely affected enzyme stability (only 10 and 8 days, respectively). The sodium citrate builder provided a detergent with good enzyme stability, but poor calcium binding properties.

The plot of pKCa versus mM sodium ion (FIG. 5) demonstrates that the pKCa of the polycarboxylate terpolymer builders decreased as the concentration of monovalent ions increased. In contrast, the pKCa of the other builders remained relatively constant and decreased with increasing ionic strength at a much lower rate than that of the polycarboxylates. Because enzyme stability is critical in low ionic strength systems (the wash water) as well as high ionic strength systems (packaged detergent), only builders having a pKCa profile such as that of the polycarboxylates (e. g., FIG. 5) are suitable for use in stabilized enzyme-containing detergents. Thus, to maintain enzyme stability, the builders herein must have a pKCa of at least 5.0 at a monovalent ion concentration of about 20 mm/liter and a pKCa of less than 3.5 at a monovalent ion concentration of about 400 mM/liter.

Although emphasis hall been placed on laundry detergent compositions in these examples, detergent compositions for all cleaning purposes are included within the scope of this invention. Various modifications and improvements on the compositions herein will become readily apparent to those skilled in the art. Accordingly, the scope and spirit of the invention are to be limited only by the claims and not by the foregoing specification.

I claim:

1. A detergent composition comprising (a) from 0.5 to 65% by weight of surfactant(s) and (b) from 1 to 80% by weight of builder(s), wherein at least one percent of the builder is an interpolymer comprising repeating units of the structure:

$$\left[A-B\right]_m\left[C\right]_n$$

wherein m is a mole fraction from 0.70 to 0.95; n is a mole fraction from 0.05 to 0.30; A is derived from at least one ethylenically unsaturated mono or di-carboxylic acid monomer; B is derived from at least one ethylenically unsaturated mono or di-carboxylic acid monomer and B is not A; and C is:

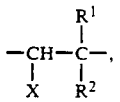

wherein X is —H,

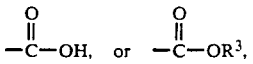

or a combination thereof, $R^1$ is —H, $—CH_3$, or $—(CH_2)_qCH_3$, or a combination thereof, and q is 1-5; $R^2$ is:

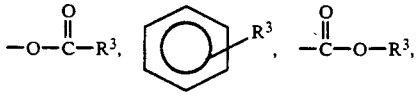

or $R^3$, or a combination thereof, and $R^3$ is a $C_{8-C18}$ linear or branched alkyl chain; the interpolymer being prepared by polymerizing the monomers in a solvent system in which the monomers and interpolymer are soluble.

2. The detergent composition of claim 1, wherein the builder is:

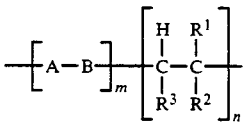

wherein A is derived from at least one ethylenically unsaturated carboxylic acid monomer; B is derived from at least one ethylenically unsaturated carboxylic acid and B is not A; $R^1$ is —H,$—CH_3$, or

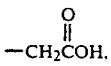

or a combination thereof; $R^2$ is

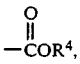

wherein $R^4$ is a $C_8$-$C_{18}$ linear or branched alkyl chain; $R^3$ is —H,$—C_3$, or

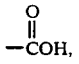

or a combination thereof; m is a molar fraction from 0.70 to 0.95; and n is a molar ratio from 0.05 to 0.30.

3. The detergent composition of claim 1, wherein the interpolymer is prepared by slowly adding a charge comprising the monomer from which C is derived to the carboxylic acid monomers over a period of time sufficient to permit instantaneous and uniform copolymerization of the monomers.

4. The detergent composition of claim 3, wherein the polymer is prepared by a process comprising the steps:

a) providing an initial charge comprising up to 100%, by weight, of at least one monomer from which A or B is derived;
b) adding to the initial charge a charge comprising at least one monomer from which C is derived; and
c) polymerizing the monomers in solution in the presence of an initiator and a non-haloalkane, hydrophobic solvent.

5. The detergent composition of claim 4, wherein the process further comprises the step of adding at least one monomer from which A or B is derived simultaneously with the charge comprising at least one monomer from which C is derived.

6. The detergent composition of claim 4, wherein the process further comprises the step of removing the solvent and recovering the interpolymer in dry form.

7. The detergent composition of claim 4, wherein the process further comprises the step of extracting the interpolymer into an aqueous solvent.

8. The detergent composition of claim 7, wherein the process further comprises the step of spray-drying the interpolymer.

9. The detergent composition of claim 7, wherein the process further comprises the step of azeotropic solvent removal.

10. The detergent composition of claim 5, wherein acrylic acid is simultaneously added with the monomer from which C is derived.

11. The detergent composition of claim 5, wherein the monomer from which C is derived is lauryl methacrylate.

12. The detergent composition of claim 4, wherein A is derived from acrylic acid, B is derived from maleic anhydride and C is derived from lauryl methacrylate.

13. The detergent composition of claim 12, wherein the molecular weight of the interpolymer is from abut 3,000 to 15,000.

14. The detergent composition of claim 1, wherein the composition further comprises at least one additional builder.

15. The detergent composition of claim 1, wherein the composition further comprises more than one surfactant.

16. The detergent composition of claim 1, comprising from about 0.05 to 30% by weight of at least one surfactant and from 1 to 65% by weight of at least one builder.

17. The detergent composition of claim 1, wherein the detergent composition is a liquid detergent.

18. The detergent composition of claim 1, wherein the detergent composition is in dry powdered form.

19. A detergent compositions comprising (a) from 0.5 to 65% by weight of surfactant(s), (b) 1 to 80% by weight of builder(s), and (c) an effective amount up to but less than 1% by weight of an anti-redeposition agent, wherein the anti-redeposition agent is an interpolymer that is not one of the builders of (b) and that comprises repeating units of the structure:

wherein m is a mole fraction from 0.70 to 0.95; n is a mole fraction from 0.05 to 0.30; A is derived from at least one ethylenically unsaturated mono or di-carboxylic acid monomer; B is derived from at least one ethylenically unsaturated mono or di-carboxylic acid monomer and B is not A; and C is:

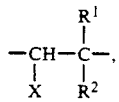

wherein X is —H,

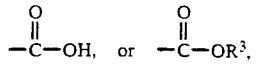

or a combination thereof, $R^1$ is —H, $—CH_3$, or $—(CH_2)_qCH_3$, or a combination thereof, and q is 1-5; $R^2$ is:

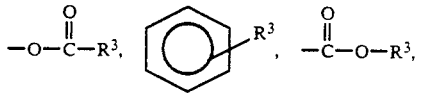

or $R^3$, or a combination thereof, and $R^3$ is a $C_{8-C18}$ linear or branched alkyl chain; the interpolymer being prepared by polymerizing the monomers in a solvent system in which the monomers and interpolymer are soluble.

20. A liquid detergent composition, comprising (a) a builder(s) having an intrinsic calcium binding constant of less than 3.5 at an ionic strength of about 400 mmols of monovalent ion, and an intrinsic calcium binding constant of at least 5.0 at an ionic strength of about 20 mmols of monovalent ion, and wherein the builder is an interpolymer comprising repeating units of the structure:

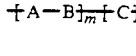

wherein m is a mole fraction from 0.70 to 0.95; n is a mole fraction from 0.05 to 0.30; A is derived from at least one ethylenically unsaturated mono or di-carboxylic acid monomer; B is derived from at least one ethylenically unsaturated mono or di-carboxylic acid monomer and B is not A; and C is:

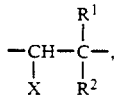

wherein X is —H,

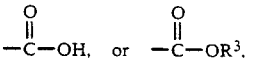

or a combination thereof, $R^1$ is —H, $—CH_3$, or $—(CH_2)_qCH_3$, or a combination thereof, and q is 1-5; $R^2$ is:

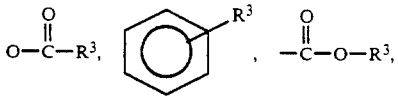

or a combination thereof, and $R^3$ is a $C_{8-C18}$ linear or branched alkyl chain; the interpolymer being prepared by polymerizing the monomers in a solvent system in which the monomers and interpolymer are soluble; and (b) a calcium-sensitive enzyme(s), wherein the calcium-sensitive enzyme(s), is characterized by stability in the presence of the builder(s).

21. The detergent composition of claim 20, wherein the detergent composition comprises 0.5 to 20%, by weight, of the builder.

22. The detergent composition of claim 20, wherein the interpolymer is prepared by slowly adding a charge comprising the monomer from which C is derived to the carboxylic acid monomers over a period of time sufficient to permit instantaneous and uniform copolymerization of the monomers.

23. The detergent composition of claim 21, wherein the interpolymer is prepared by a process comprising the steps of:

a) providing an initial charge comprising up to 100%, by weight, of at least one monomer from which A or B is derived;

b) adding to the initial charge a charge comprising at least one monomer from which C is derived; and c) polymerizing the monomers in solution in the presence of an initiator and a non-haloalkane, hydrophic solvent.

24. The detergent composition of claim 21, wherein the process further comprises the step of adding at least one monomer from which A or B is derived simultaneously with the charge comprising at least one monomer from which C is derived.

25. The detergent composition of claim 23, wherein the process further comprises the step of removing the solvent and recovering the interpolymer in dry form.

26. The detergent composition of claim 23, wherein the process further comprises the step of extracting the interpolymer into an aqueous solvent.

27. The detergent composition of claim 26, wherein the process further comprises the step of spray-during the interpolymer.

28. The detergent composition of claim 26, wherein the process further comprises the step of azeotropic solvent removal.

29. The detergent composition of claim 24, wherein acrylic acid is simultaneously added with the monomer from which C is derived.

30. The detergent composition of claim 24, wherein the monomer from which C is derived is lauryl methacrylate.

31. The detergent composition of claim 23, wherein A is derived from acrylic acid, B is derived from maleic anhydride and C is derived from lauryl methacrylate.

32. The detergent composition of claim 31, wherein the molecular weight is from about 3,000 to 15,000.

33. The detergent composition of claim 20, wherein the detergent composition is an isotropic liquid and the builder is soluble in the isotropic liquid.

34. The detergent composition of claim 20, wherein the detergent composition is a structured liquid and the builder is suspended in the structured liquid.

35. The detergent composition of claim 20, wherein the calcium-sensitive enzyme is a protease.

* * * * *